US006062966A

United States Patent [19]

Ali et al.

[11] Patent Number: 6,062,966

[45] **Date of Patent: *May 16, 2000**

[54] SANDING BLOCK

[76] Inventors: Frank Ali; Chris Ali, both of 611 Yellow Springs-Fairfield Rd., Fairborn, Ohio 45324

[ * ] Notice: This patent is subject to a terminal disclaimer.

[21] Appl. No.: 09/183,978

[22] Filed: Oct. 31, 1998

Related U.S. Application Data

[63] Continuation-in-part of application No. 08/900,098, Jul. 25, 1997, Pat. No. 5,863,243.

[51] Int. Cl.[7] ..... B24B 9/10

[52] U.S. Cl. ..... 451/503; 451/523

[58] Field of Search ..... 451/502, 503, 451/514, 523, 524

[56] References Cited

U.S. PATENT DOCUMENTS 5,863,243 1/1999 Ali ..... 451/503

*Primary Examiner*—Timothy V. Eley
*Assistant Examiner*—Dung Van Nguyen
*Attorney, Agent, or Firm*—R. William Graham

[57] ABSTRACT

A sanding block has a first member having an intermediate portion and a pair of relatively flexible ends wherein a top surface of the first member is configured to be hand held and a bottom surface of each of the ends has at least one retention open surface therein, a second member having an intermediate portion connected to the intermediate portion of the first member and a pair of ends wherein a top surface of each end of the second member has extending therefrom at least one complementary retention protrusion which respectively seat in one of the retention open surfaces, wherein the sanding block includes at least one hollow surface formed therein, and having a relatively lightweight support member disposed within the hollow surface.

12 Claims, 3 Drawing Sheets

SANDING BLOCK

This is a continuation-in-part of U.S. Ser. No. 08/900,098 filed Jul. 25, 1997 now U.S. Pat. No. 5,863,243 entitled SANDING BLOCK.

BACKGROUND OF THE INVENTION

1. Field of the Invention

The invention relates generally to the field of sanding devices. More particularly, but not by way of limitation, the present invention relates to improvements in sanding blocks.

2. Related Art

There presently exist a variety of styles of sanding blocks. These sanding blocks are generally integrally formed of rubber and typically include a first member having an intermediate portion and a pair of ends wherein a top surface of the first member is configured to be hand held and a bottom surface of each of the ends has retention surfaces therein and a second member having an intermediate portion connected to the intermediate port ion of the first member and a pair of ends wherein a top surface of each end of the second member has a plurality of nails complementary formed to respectively seat in one of the retention open surfaces. The respective first ends must be pried apart such that the nails are removed from the retention surfaces so that an end of a piece of sandpaper can be disposed between the first ends whereupon release of the ends, the nails pierce the sandpaper to hold the same in place. The second ends are likewise manipulated to retain the other end of the sandpaper.

As a whole, sanding blocks have not evolved to meet the needs of the user. For example, it is desirable to minimize fatigue to the user while maintaining the effectiveness of the sanding block. The rubber material employed in these blocks is relatively rigid, dense and heavy and difficult for the user to pry apart and use for long period of time. This is particularly true for woman which are increasingly entering into the do-it-yourself (DIY) market.

Recently, applicant has alleviated some of these problems. Particularly, the applicant in co-pending U.S. application Ser. No. 08/90,0098 discloses a ribbed gripping surface and chamfered surface portions between the ends of the first and second members to aid in sanding use. While these changes have been helpful in gripping the block as well as prying apart the ends of the block, there remains a need to improve other aspects of sanding blocks.

The present invention overcomes other deficiencies of present sanding blocks. The present invention also better meets the needs of present day consumer.

BRIEF SUMMARY OF THE INVENTION

It is an object to improve sanding blocks.

It is another object to enhance the ease of use of sanding blocks while maintaining effectiveness of the same in a cost efficient manner.

It is also an object to provide a relatively inexpensive sanding block with a means of marking the same.

Accordingly, the present invention is directed to a sanding block having a first member having an intermediate portion and a pair of relatively flexible ends wherein a top surface of the first member is configured to be hand held and a bottom surface of each of the ends has at least one retention open surface therein and a second relatively rigid member having an intermediate portion connected to the intermediate portion of the first member and a pair of ends wherein a top surface of each end of the second member has extending therefrom at least one complementary retention protrusion which respectively seat in ore of the retention open surfaces, and wherein the sanding block includes at least one hollow surface formed therein and having a relatively lightweight support member disposed within the hollow surface. The sanding block is further characterized such that the hollow surface extends through a part of the top surface of the first member and the support member extends throughout the hollow surface and has a top surface remaining partially visible. The top surface of the support member includes a predetermined marking.

Other objects and advantages will be readily apparent to those skilled in the art upon viewing the drawings and reading the detailed description hereafter.

DETAILED DESCRIPTION OF THE INVENTION

Figure 1:
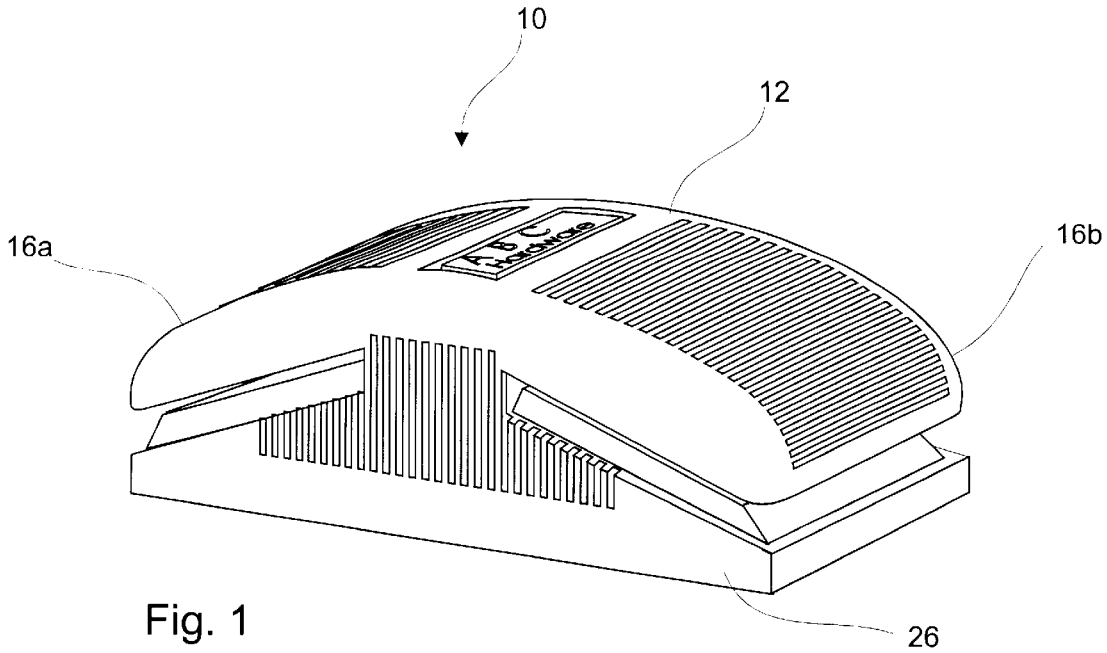
FIG. 1 is a perspective view of the present invention.
Figure 2:
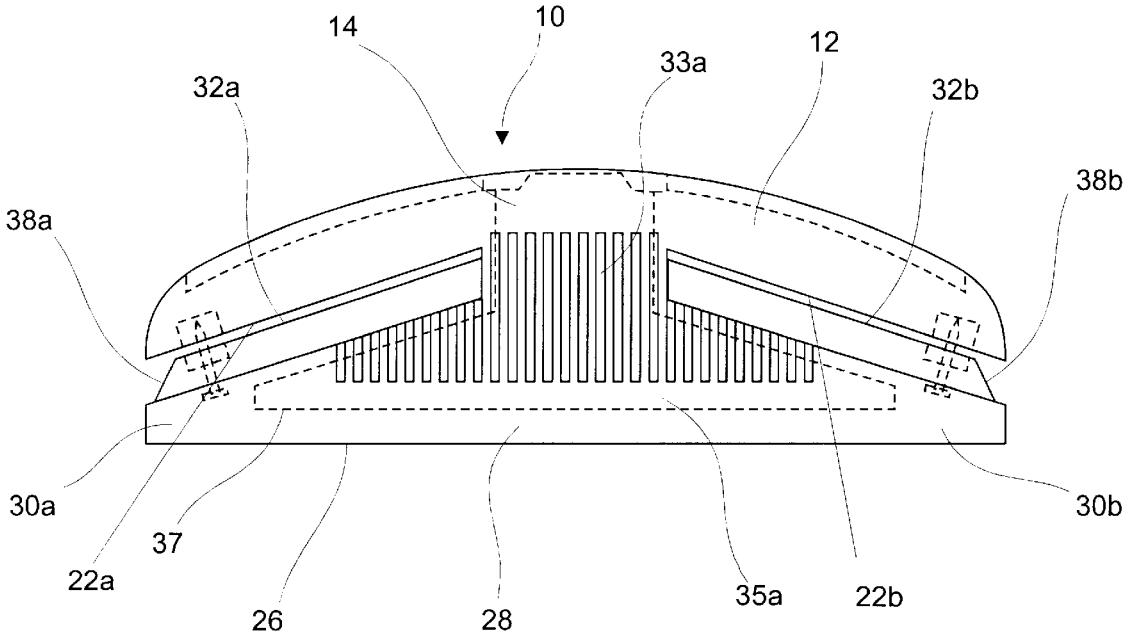
FIG. 2 is a side view of the present invention.
Figure 3:
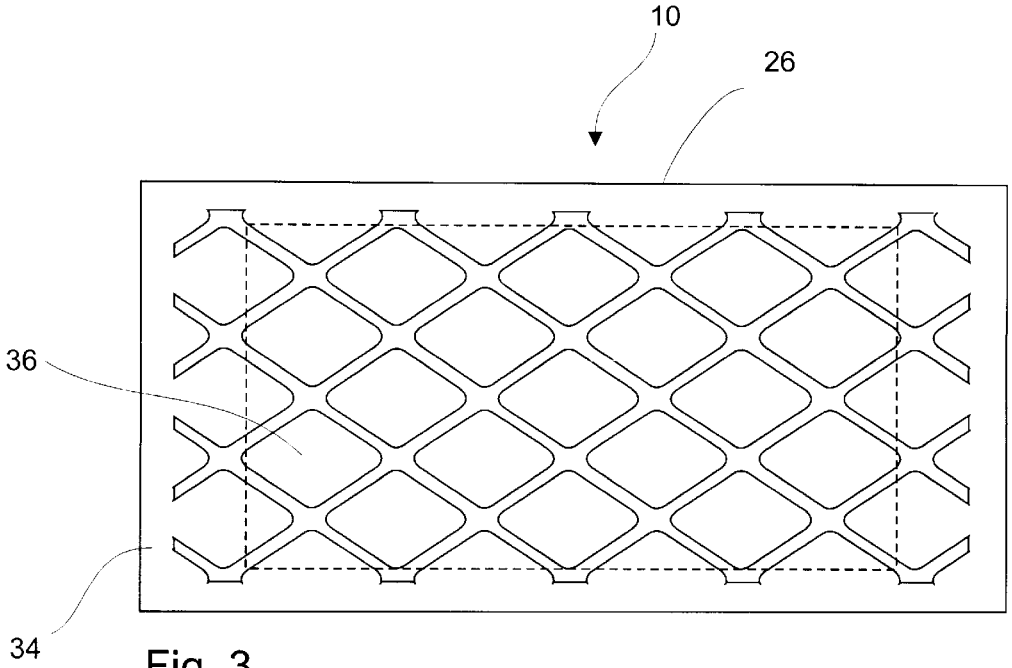
FIG. 3 is a bottom view of the present invention
Figure 4:
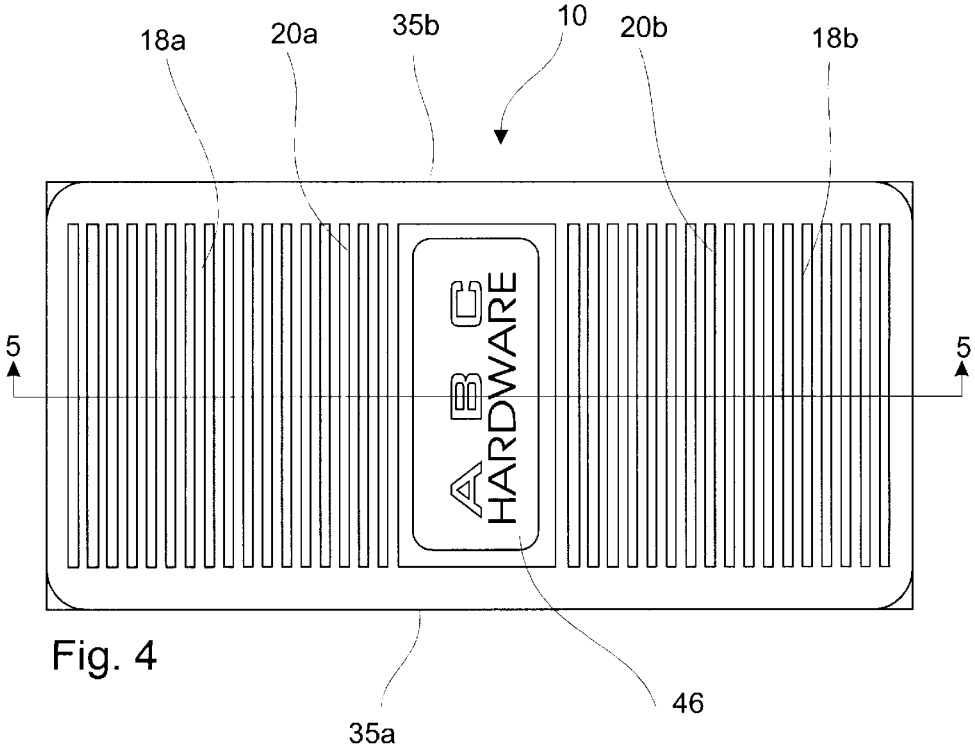
FIG. 4 is a top view of the present invention.

Referring now to the drawings in FIGS. 1–5, the sanding block of the present invention is generally referred to by the numeral 10. The sanding block 10 has a first member 12 which has an intermediate portion 14 and a pair of relatively flexible ends 16*a* and 16*b*. A top surface 18 of the first member 12 is configured to be hand held. In this regard, the top surface 18 of the first member 12 has surface portions 18*a* and 18*b* which have a plurality of relatively flexible treads 20*a* and 20*b*, respectively, formed transversely thereon. These treads 18*a* and 18*b* aid the user in gripping the sanding block. Bottom surfaces 22*a* and 22*b* of each of the ends 16*a* and 16*b*, respectively, each have a plurality of retention open surfaces 24*a* and 24*b*, respectively.

The sanding block 10 has a second member 26 having an intermediate portion 28 connected, preferably integrally, to the intermediate portion 14 of the first member 12. The second member 26 also has a pair of ends 30*a* and 30*b* which are disposed adjacent ends 16*a* and 16*b*, respectively, and are generally of about the same length. Each of the ends 30*a* and 30*b* have a top surface 32*a* and 32*b*, respectively, which face the bottom surfaces 22*a* and 22*b*, respectively.

Treads 33*a* and 33*b* are provided on side surfaces 35*a* and 35*b* of the sanding block 10 to aid the user in gripping the sanding block 10. The second member 26 has a bottom surface 34 best seen in FIG. 3 and has a plurality of relatively nonflexible treads 36 formed thereon to aid in not only gripping the back side of the sandpaper but also in its removal of sticky back sandpaper, for example.

Chamfered surface portions 38*a* and 38*b* extend along a periphery of top surfaces 32*a* and 32*b*, respectively. Here, the chamfered surface portions 38*a* and 38*b* are preferably chamfered at a sufficient slant to permit the bottom surfaces 22*a* and 22*b* to be gripped with a user's pad of a finger tip in a manner such that the user's finger nail is less likely to be damaged in prying apart the ends 16 from ends 30 in order to insert a piece of sandpaper therebetween.

The first member 12 and the second member 26 are preferably integrally formed via a molding process. The first member 12 and second member 26 are preferably made of a relatively flexible thermoplastic polymer which is cross-linked only to an extent to solidify the material to provide a rubber-like characteristic. Polyvinyl chloride is a suitable and preferable material in this regard. The material characteristics of the members 12 and 26 described have desirable attributes of touch and feel for handling by the user as well as function in aiding to perform certain objectives herein. It is recognized that other relatively flexible materials may be employed to provide such attributes.

While the characteristics of the rubber-like material are desirable for the sanding block 10, the material which provides such desirable characteristics does have its drawbacks. Such material is relatively dense and heavy and accordingly leads to fatigue of the user at a faster rate. Also, the material is relatively expensive and it is desirable to reduce the amount of material needed. The inherent properties of the rubber-like material of he sanding block 10 requires a solid or pseudo-solid support structure. This is because such rubber-like material tends to collapse in on itself during the particular molding process where a hollow surface exists.

Figure 5:
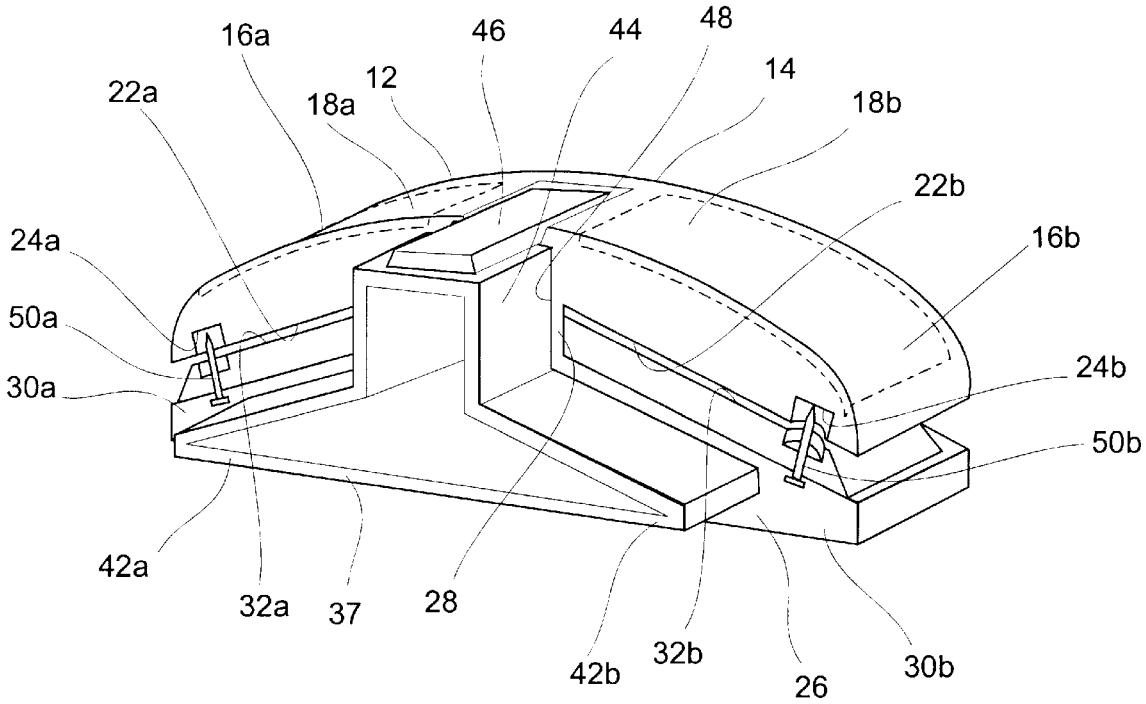
FIG. 5 is a partial cross-sectional perspective view of the present invention taken through line 5—5 of FIG. 4.

To overcome this problem, the present invention provides a relatively lightweight rigid plastic support member 37 which is best seen in FIGS. 1 and 5. The support member 37 is made of a thermoplastic resin which is preferably cross-linked to an extent to provide a hard solid, high strength support structure. Polystyrene, white for example, is desirable in this regard as it is relatively inexpensive and performs the desired objectives, but other rigid materials may be employed to accomplish the purposes described herein.

The support member 37 is pre-molded into a generally hollow T-shape. The material of the support member 37 serves as a lightweight insert which occupies a substantial volume of space within the sanding block 10, while leaving in tact the desirable attributes of the members 12 and 26. Thus, the support member 37 reduces cost of the sanding block 10 and enhances the usefulness by providing a lighter sanding block 10 which will not fatigue the user as quickly.

The support member 37 has two arms 42*a* and 42*b* which are to be disposed within the second member 26 and an intermediate leg 44 which has a top surface 46 and extends within the sanding block 10 from the intermediate portion 28 of the second member 26 and through the intermediate portion 14 of the first member 12.

The top surface 46 will preferably remain exposed to visibility. This provides another feature of the present invention. The top surface 46 can be cut and/or marked with a private label for a retailer to display a desired house brand, preferably prior to the molding process. In this way, there only need be a one mold produced for the formation of the first member 12 and second member 26 with the support member 37 inserted therein. The support member 37 is set into such mold in an inverted manner, wherein the mold is cut to produce an integral formation of the first member 12 and second member 26 about the support member 37.

By so doing, a hollow surface 48 is formed within the sanding block 10 within which the support member 37 seats against. The hollow surface 48 takes on a generally complimentary configuration to the support member 37, save for the top surface 46 which is left open for exposure thereof as previously discussed. The arms 42*a* and 42*b* are of a width and height slightly less than the ends 30*a* and 30*b* of the second member 25 and lend substantial rigidity throughout the same.

A plurality of retention protrusions (spikes) 50*a* and 50*b* extend from top surfaces 32*a* and 32*b*, respectively. The spikes 50 are preferably integrally formed into the sanding block 10 during the molding process. The retention protrusions 50*a* and 50*b* respectively removably seat in the retention open surfaces 24*a* and 24*b*.

The sanding block 10 of the present invention now overcomes the disadvantages of prior sanding blocks. A relatively lightweight and inexpensive sanding block 10 is provided with the aforesaid desired external attributes.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A sanding block for hand held use, which includes:

a first member having an intermediate portion and a pair of relatively flexible ends wherein a top surface of said first member is configured to be hand held and a bottom surface of each of said ends has at least one retention open surface therein;

a second member having an intermediate portion connected to said intermediate portion of said first member and a pair of ends wherein a top surface of each said end of said second member has extending therefrom at least one complementary retention protrusion which respectively seat in one of said retention open surfaces; and wherein said sanding block includes at least one hollow surface formed therein; and a relatively lightweight support member disposed within said hollow surface.

2. The sanding block of claim 1, wherein said hollow surface extends through a part of said top surface of said first member and said support member extends throughout said hollow surface and has an exposed surface visible adjacent said top surface of said first member.

3. The sanding block of claim 2, wherein said exposed surface of said support member includes a predetermined marking.

4. The sanding block of claim 1, wherein said hollow surface is generally T-shaped.

5. The sanding block of claim 4, wherein said support member is generally T-shaped.

6. The sanding block of claim 4, wherein said T-shaped hollow surface is inverted to and substantially extends within said second member and said intermediate portions.

7. The sanding block of claim 6, wherein said support member is complementarily configured to said hollow surface.

8. The sanding block of claim 1, wherein said ends of one of said first member and said second member have a chamfered edge extending along a periphery thereof.

9. The sanding block of claim 1, which is further characterized as having said chamfered edge extending about said top surface of each end of said second member.

10. The sanding block of claim 1, wherein said top surface of said first member has a plurality of relatively flexible treads formed thereon.

11. The sanding block of claim 1, wherein said second member has a bottom surface having a plurality of relatively nonflexible treads formed on the surface thereof.

12. The sanding block of claim 1, wherein said first member and said second member have sides and wherein at least one of said sides has a plurality of relatively flexible treads formed thereon.

* * * * *